US012357890B2

(12) United States Patent
Audia

(10) Patent No.: US 12,357,890 B2
(45) Date of Patent: Jul. 15, 2025

(54) GOLF BAG ASSEMBLY

(71) Applicant: Travis Audia, Bend, OR (US)

(72) Inventor: Travis Audia, Bend, OR (US)

( * ) Notice: Subject to any disclaimer, the term of this patent is extended or adjusted under 35 U.S.C. 154(b) by 346 days.

(21) Appl. No.: 18/112,069

(22) Filed: Feb. 21, 2023

(65) Prior Publication Data

US 2024/0278091 A1 Aug. 22, 2024

(51) Int. Cl.

| | |
|---|---|
| ***A63B 55/30*** | (2015.01) |
| ***A45C 5/14*** | (2006.01) |
| ***A45C 13/26*** | (2006.01) |
| ***A45C 15/00*** | (2006.01) |
| ***A45F 3/04*** | (2006.01) |
| ***A63B 55/00*** | (2015.01) |
| ***A63B 55/40*** | (2015.01) |
| *A45F 3/00* | (2006.01) |
| *A63B 57/20* | (2015.01) |
| *A63B 71/06* | (2006.01) |

(52) U.S. Cl.

CPC ..... *A63B 55/408* (2015.10); *A45C 5/14* (2013.01); *A45C 13/262* (2013.01); *A45C 15/00* (2013.01); *A45F 3/04* (2013.01); *A63B 55/30* (2015.10); *A63B 55/40* (2015.10); *A45C 2013/267* (2013.01); *A45F 2003/003* (2013.01); *A63B 57/203* (2015.10); *A63B 2071/0625* (2013.01); *A63B 2225/50* (2013.01)

(58) Field of Classification Search

CPC ..... A63B 55/408; A63B 55/30; A63B 55/40; A63B 57/203; A63B 2071/0625; A63B 2225/50; A45C 5/14; A45C 13/262; A45C 15/00; A45C 2013/267; A45C 2013/265; A45C 3/04; A45C 2003/003

See application file for complete search history.

(56) References Cited

U.S. PATENT DOCUMENTS 2,763,309 A * 9/1956 Jones ..... A63B 55/40 206/315.6
2,879,819 A * 3/1959 Turnbull ..... A63B 55/40 150/160
3,779,297 A * 12/1973 Stammer ..... A63B 55/00 206/315.6

(Continued)

FOREIGN PATENT DOCUMENTS

ES 2924449 A1 * 10/2022 ..... A45F 3/10
GB 2511848 A * 9/2014 ..... A45F 3/04

(Continued)

*Primary Examiner* — Steve Clemmons

(57) ABSTRACT

A golf bag assembly includes an article of luggage that has a rotating mount which is rotatably attached to the article of luggage. A golf club holder is removably attachable to the rotating mount. The golf club holder has a plurality of tubes and each of the plurality of tubes insertably receives a respective one of a plurality of golf clubs. A pair of rollers is each positionable in a retracted position or a deployed position thereby. A handle is pivotally coupled to the article of luggage and the handle is positionable in a deployed position thereby facilitating the handle to be gripped for transporting the article of luggage on the rollers. The handle is positionable in a stored position having the handle angling downwardly from the article of luggage thereby facilitating the handle to support the article of luggage in the convention of a kickstand.

12 Claims, 13 Drawing Sheets

(56) References Cited

U.S. PATENT DOCUMENTS 4,136,724 A * 1/1979 Leitzel ..... B62B 1/042 206/315.6
4,182,391 A * 1/1980 Kjose ..... A63B 55/40 224/580
4,340,227 A * 7/1982 Dopkowski ..... A63B 60/00 473/307
4,941,603 A 7/1990 Creamer
D387,556 S 12/1997 Beebe
6,179,176 B1 * 1/2001 Saggese ..... A45F 3/04 190/18 R
6,336,577 B1 1/2002 Harris
6,422,444 B1 * 7/2002 Richardson ..... A63B 55/50 206/315.3
6,460,747 B1 10/2002 Tuerschmann
7,237,660 B2 * 7/2007 Wu ..... A45C 5/146 280/655
7,337,935 B1 * 3/2008 Glanville ..... A45F 3/10 224/628
7,419,037 B2 * 9/2008 Nordstrom ..... A45C 13/262 280/37
7,717,263 B2 * 5/2010 Evans ..... A63D 15/10 190/18 R
7,775,901 B2 * 8/2010 Cooper ..... A63B 57/203 206/315.6
8,146,740 B2 * 4/2012 Tan ..... A63B 55/30 280/DIG. 6
9,084,920 B2 * 7/2015 Andochick ..... A45C 5/14
9,636,557 B1 * 5/2017 Frank ..... A63B 55/30
10,172,429 B1 * 1/2019 Smith ..... A45C 13/10
11,395,944 B2 * 7/2022 Kurzynski ..... A63B 55/40
2004/0090047 A1 * 5/2004 Kang ..... B62B 1/125 280/652
2004/0195791 A1 10/2004 Brookes-Inglis
2007/0241008 A1 * 10/2007 Weavind ..... A63B 55/40 206/315.6
2008/0187166 A1 8/2008 Ko
2008/0210728 A1 9/2008 Bihn
2009/0145787 A1 * 6/2009 Grander ..... A63B 55/50 206/315.6
2009/0152144 A1 * 6/2009 Anderson ..... A45F 3/12 224/264
2010/0176012 A1 * 7/2010 Carter ..... A45F 5/1566 206/315.3
2012/0012482 A1 * 1/2012 Koepnick ..... A63B 55/50 206/315.6
2012/0286718 A1 * 11/2012 Richards ..... A45F 3/04 320/103
2012/0294550 A1 * 11/2012 Hassman ..... A45C 11/20 383/6
2014/0187342 A1 * 7/2014 Brady ..... A45F 3/04 473/288
2021/0145137 A1 * 5/2021 Williams ..... A45F 5/1566
2023/0149783 A1 * 5/2023 Huguelet ..... A45F 3/04 224/577

FOREIGN PATENT DOCUMENTS

GB 2541180 A * 2/2017 ..... A45C 3/00
WO WO02102185 12/2002

* cited by examiner

GOLF BAG ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to golf bag devices and more particularly pertains to a new golf bag device for carrying golf clubs and any associated hardware for the game of golf. The device includes an article of luggage that has a rotating mount attached to the article of luggage and a golf club holder that is removably attachable to the rotating mount. The device includes a communication unit for streaming an audio signal from an audio source. The device includes rollers that are retractably integrated into the article of luggage and a handle pivotally attached to the article of luggage. The handle can be oriented at a variety of angles such that the article of luggage can be supported on the handle in the convention of a kickstand.

(2) Description of Related Art Including Information Disclosed Under 37 CFR 1.97 and 1.98

The prior art relates to golf bag devices including a backpack device that has a plurality of thermally insulated compartments for carrying food items. The prior art back pack cooler that is comprised of a thermally insulated material for carrying cold food items. The prior art discloses a golf back that includes a shoulder harness for carrying on user's shoulders. The prior art discloses a backpack device that includes rollers and a telescopic handle. The prior art discloses a backpack device that includes speakers integrated into respective shoulder straps of a backpack. The prior art discloses a backpack device that includes a solar panel mounted to a backpack.

BRIEF SUMMARY OF THE INVENTION

An embodiment of the disclosure meets the needs presented above by generally comprising an article of luggage that has a rotating mount which is rotatably attached to the article of luggage. A golf club holder is removably attachable to the rotating mount. The golf club holder has a plurality of tubes and each of the plurality of tubes insertably receives a respective one of a plurality of golf clubs. A pair of rollers is each positionable in a retracted position or a deployed position thereby. A handle is pivotally coupled to the article of luggage and the handle is positionable in a deployed position thereby facilitating the handle to be gripped for transporting the article of luggage on the rollers. The handle is positionable in a stored position having the handle angling downwardly from the article of luggage thereby facilitating the handle to support the article of luggage in the convention of a kickstand.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
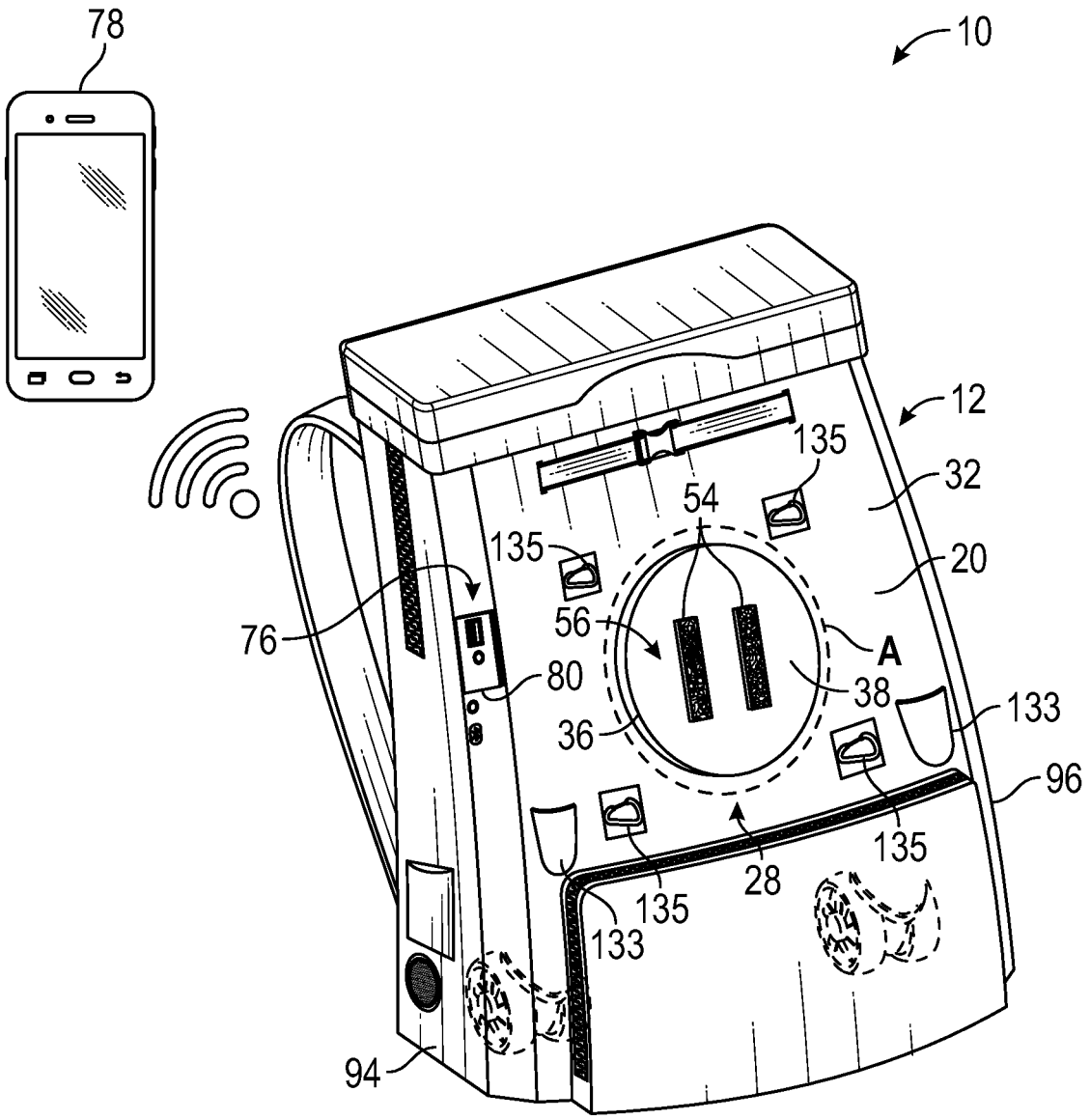
FIG. 1 is a front phantom perspective view of a golf bag assembly according to an embodiment of the disclosure.
Figure 2:
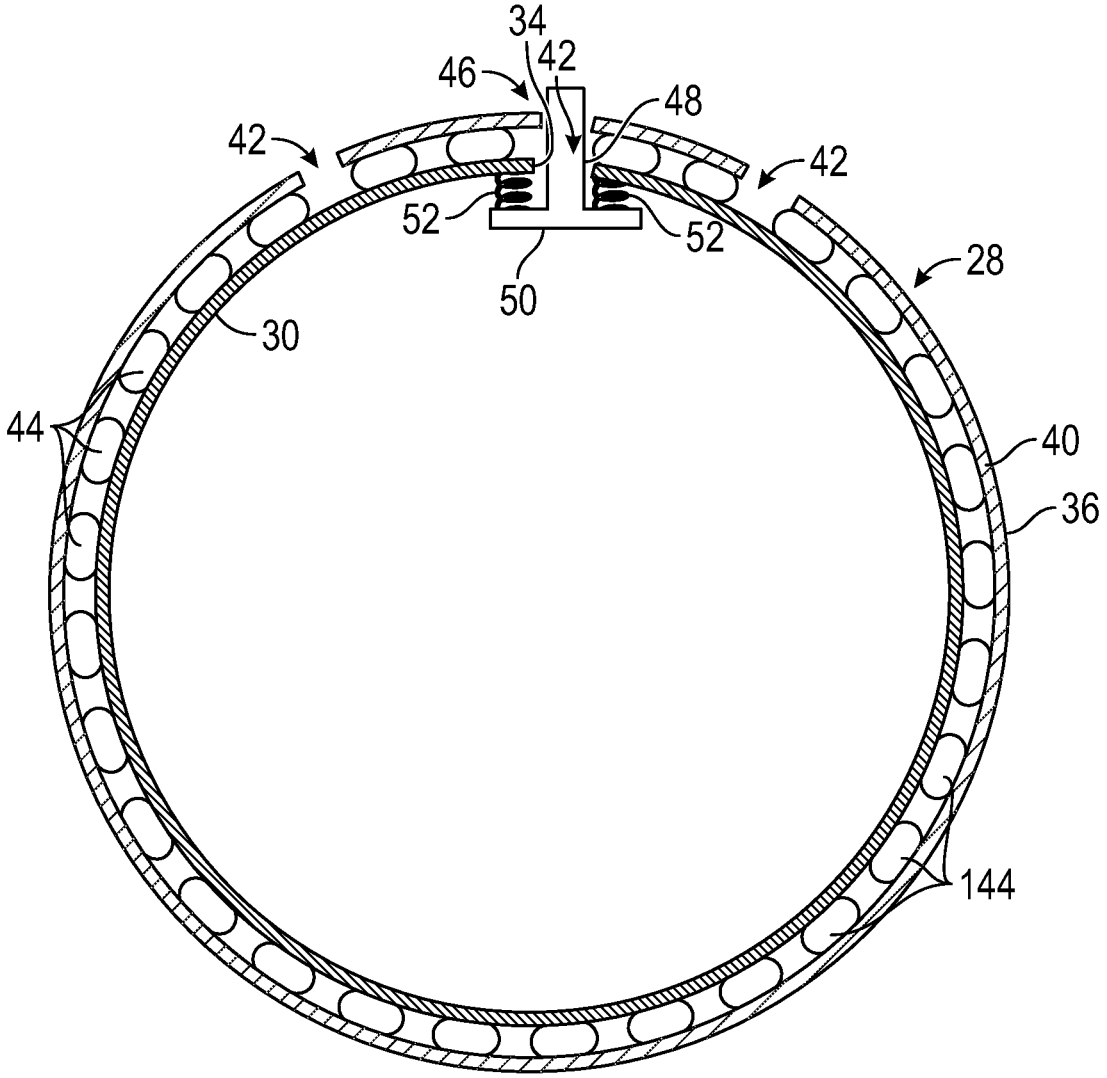
FIG. 2 is a detail cut-away view taken from circle A of FIG. 1 of an embodiment of the disclosure.
Figure 3:
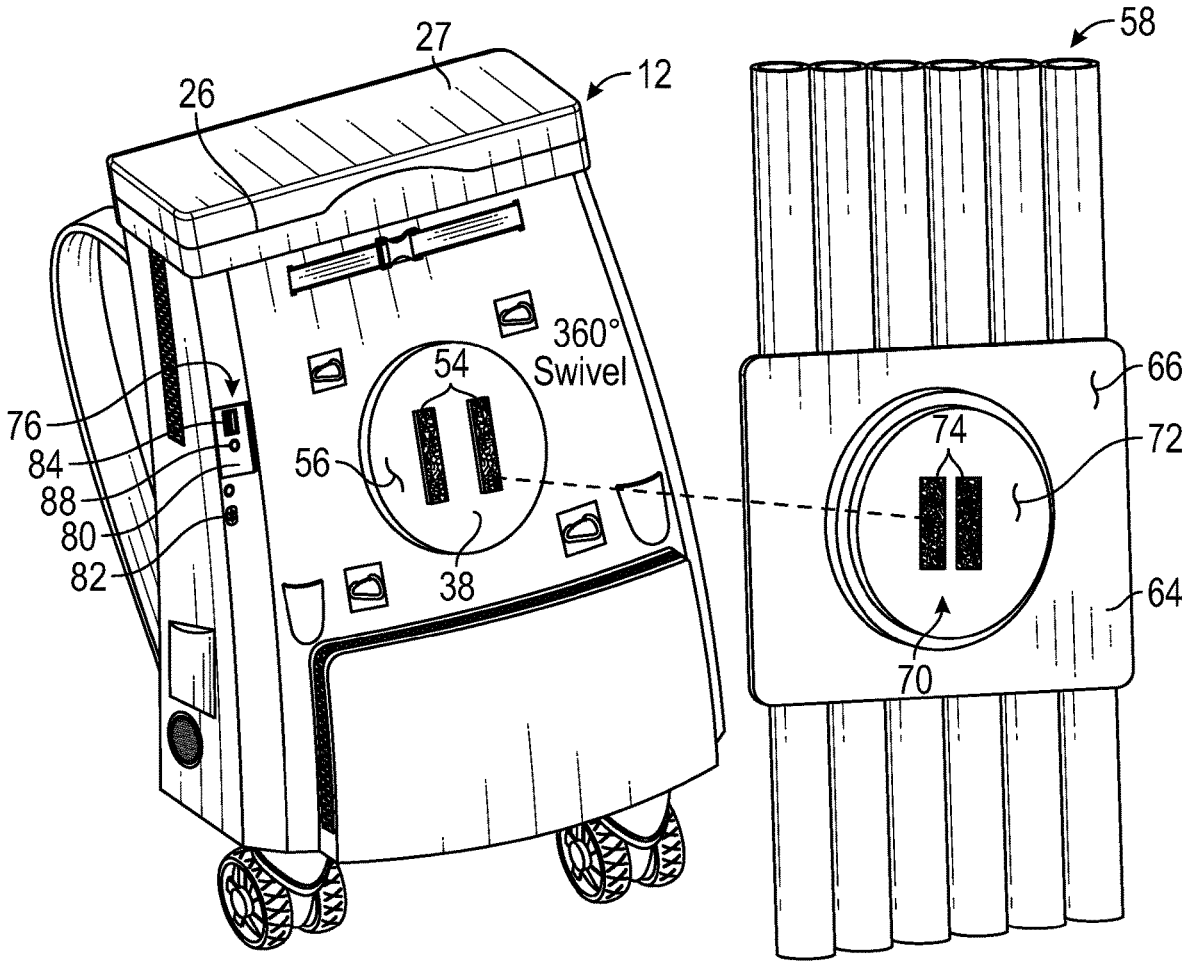
FIG. 3 is a front exploded view of an embodiment of the disclosure.
Figure 4:
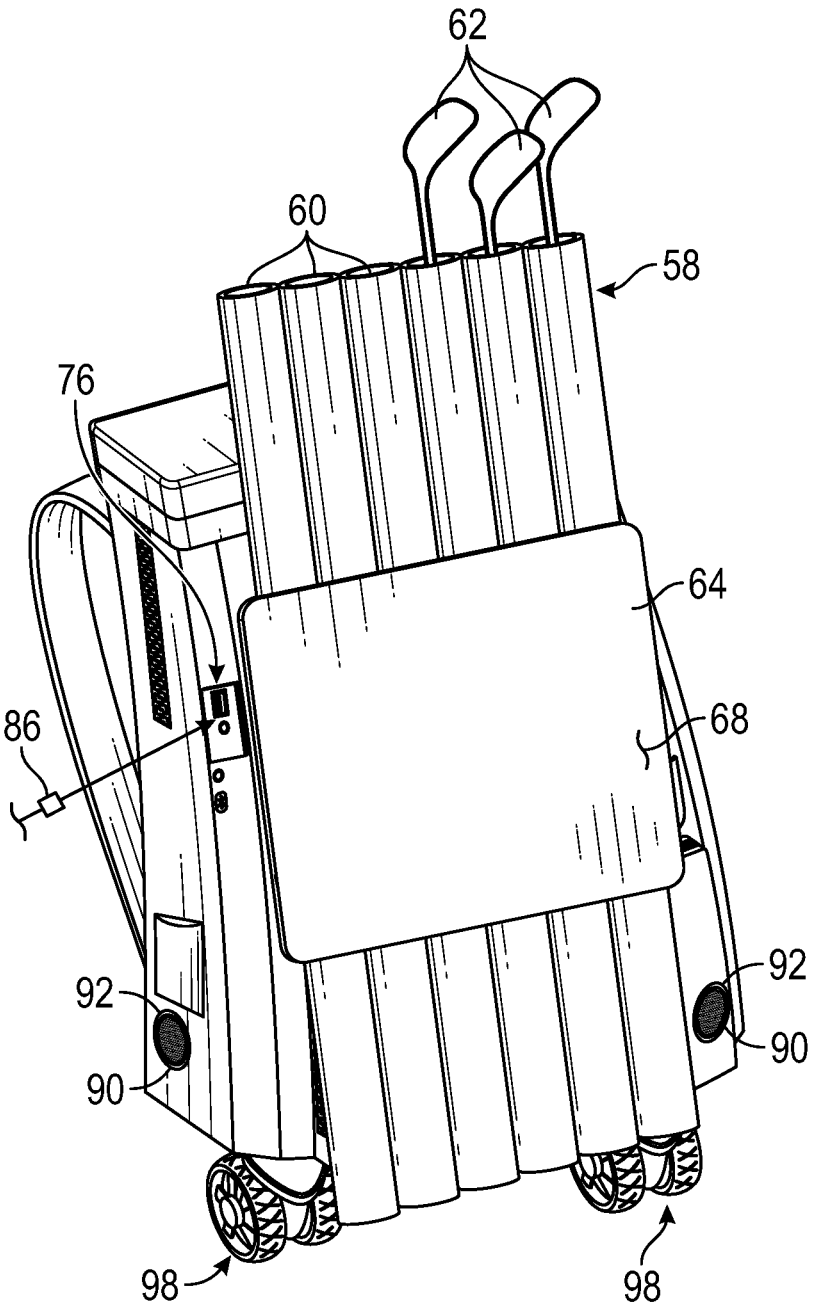
FIG. 4 is a front perspective view of an embodiment of the disclosure showing a golf club holder attached to an article of luggage.
Figure 5:
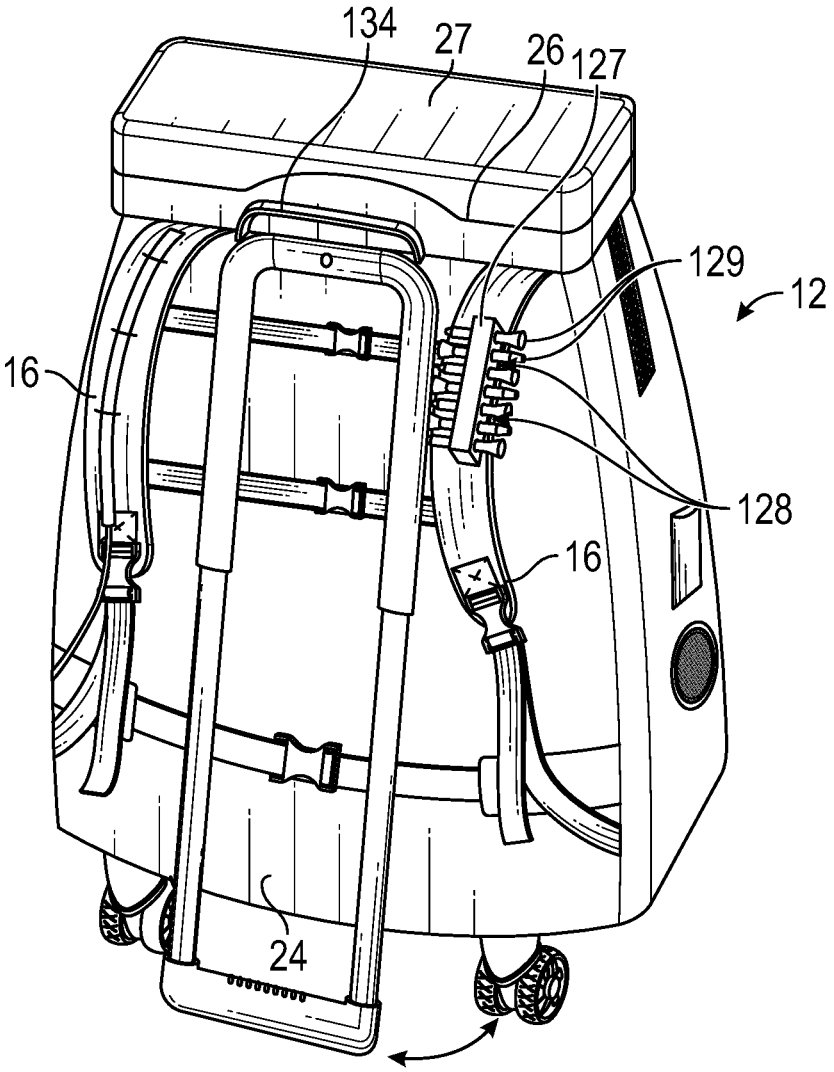
FIG. 5 is a back perspective view of an embodiment of the disclosure showing a handle in a stored position.
Figure 6:
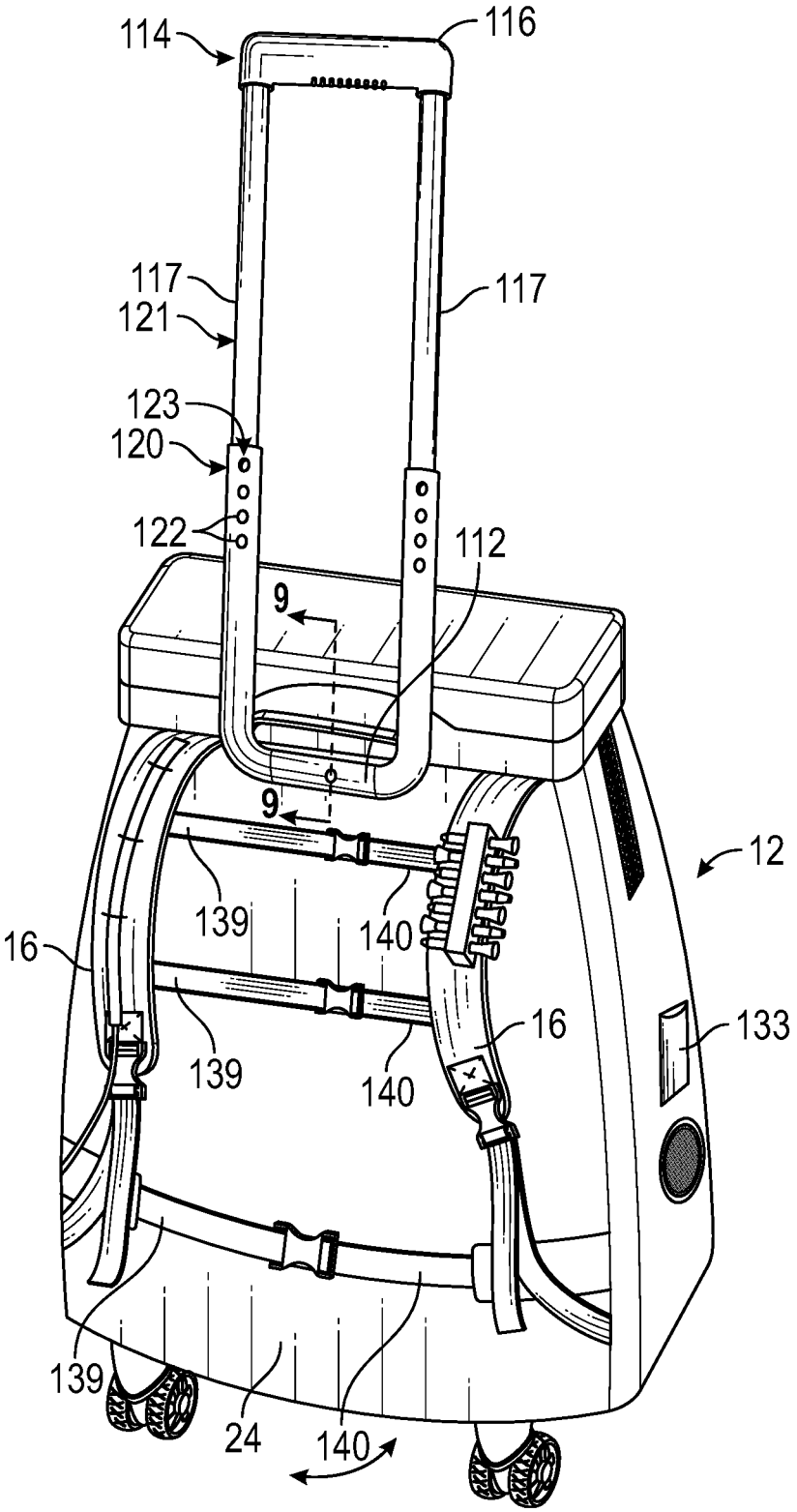
FIG. 6 is a back perspective view of an embodiment of the disclosure showing a handle in a deployed position.
Figure 7:
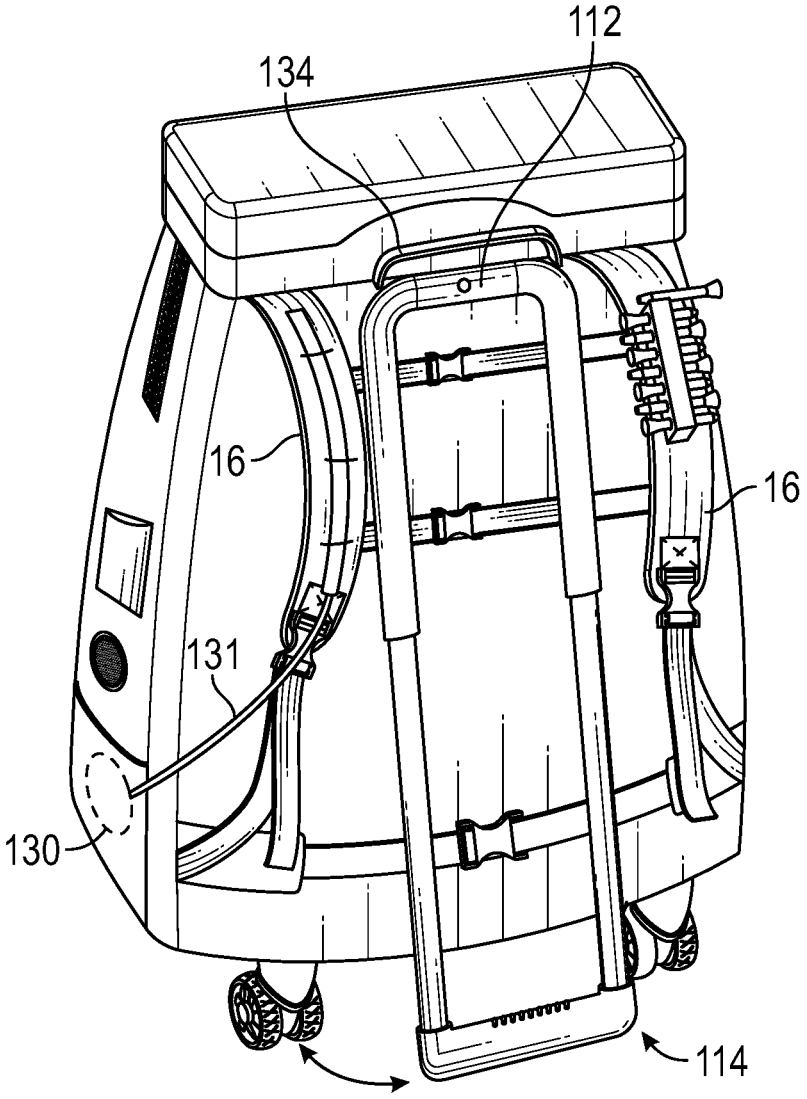
FIG. 7 is a right side perspective view of an embodiment of the disclosure.
Figure 8:
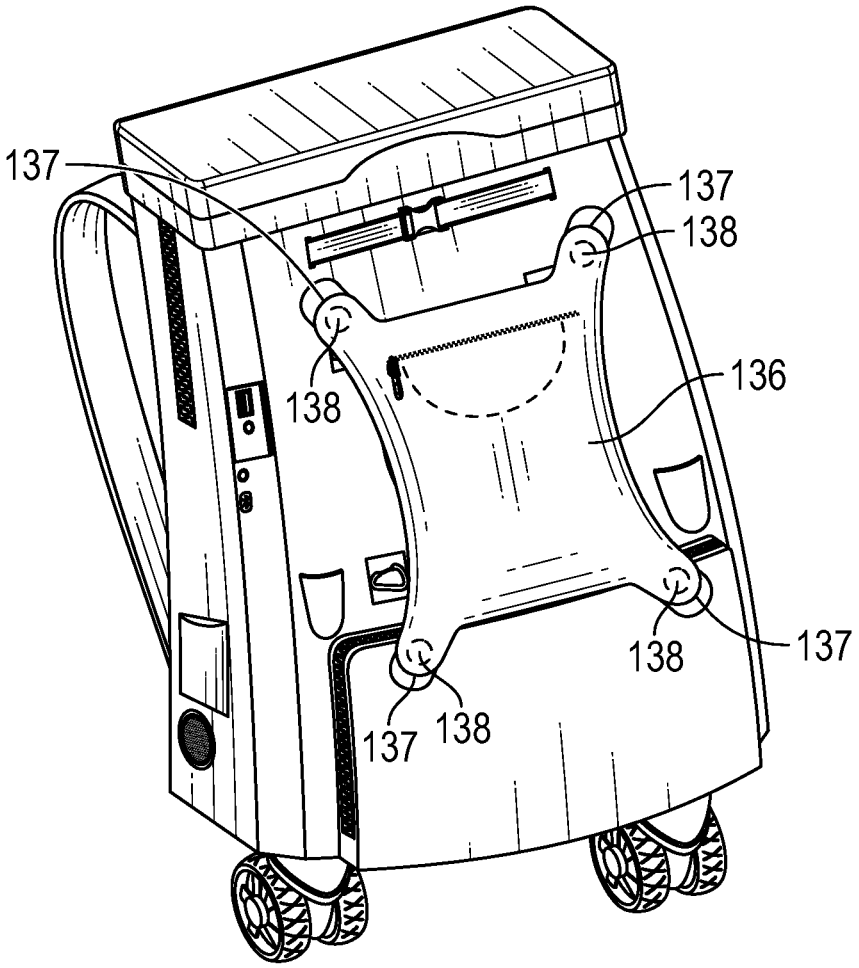
FIG. 8 is a front perspective view of an embodiment of the disclosure showing a rain fly attached to an article of luggage.
Figure 9:
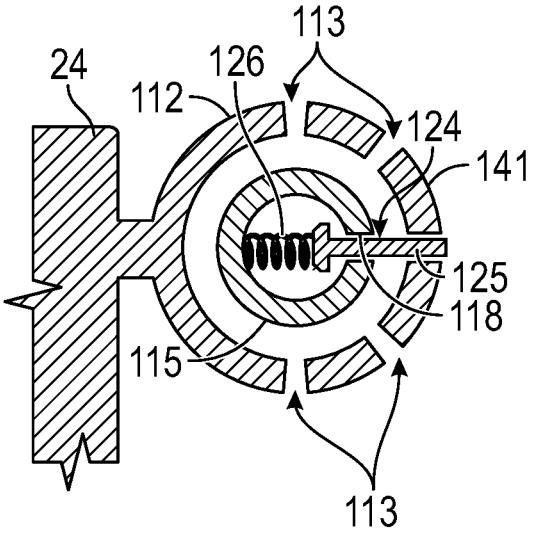
FIG. 9 is a cross sectional view taken along line 9-9 of FIG. 6 of an embodiment of the disclosure.
Figure 10:
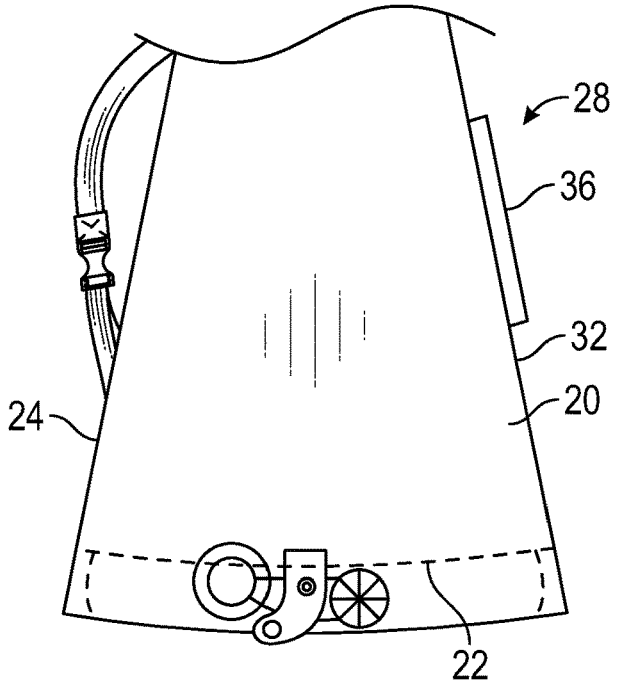
FIG. 10 is a right side phantom view of an embodiment of the disclosure showing a roller in a stored position.
Figure 11:
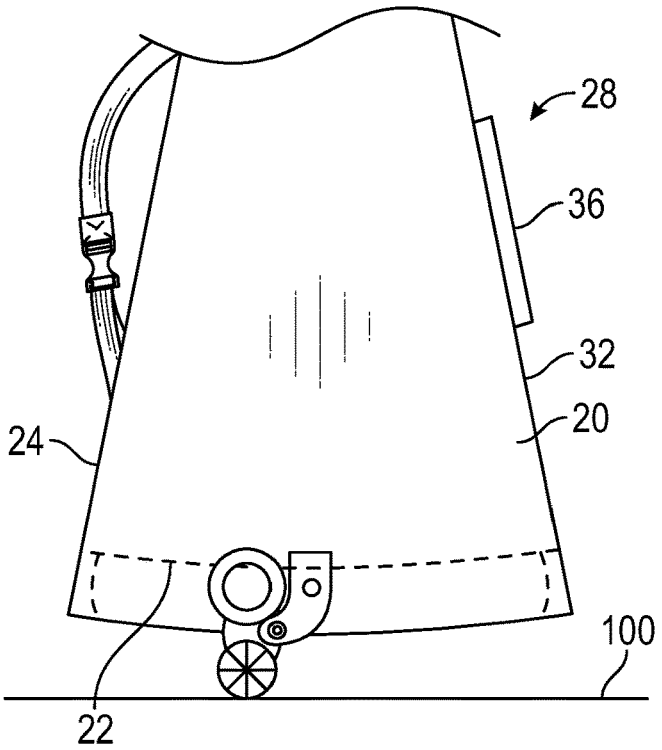
FIG. 11 is a right side phantom view of an embodiment of the disclosure showing a roller in a deployed position.
Figure 12:
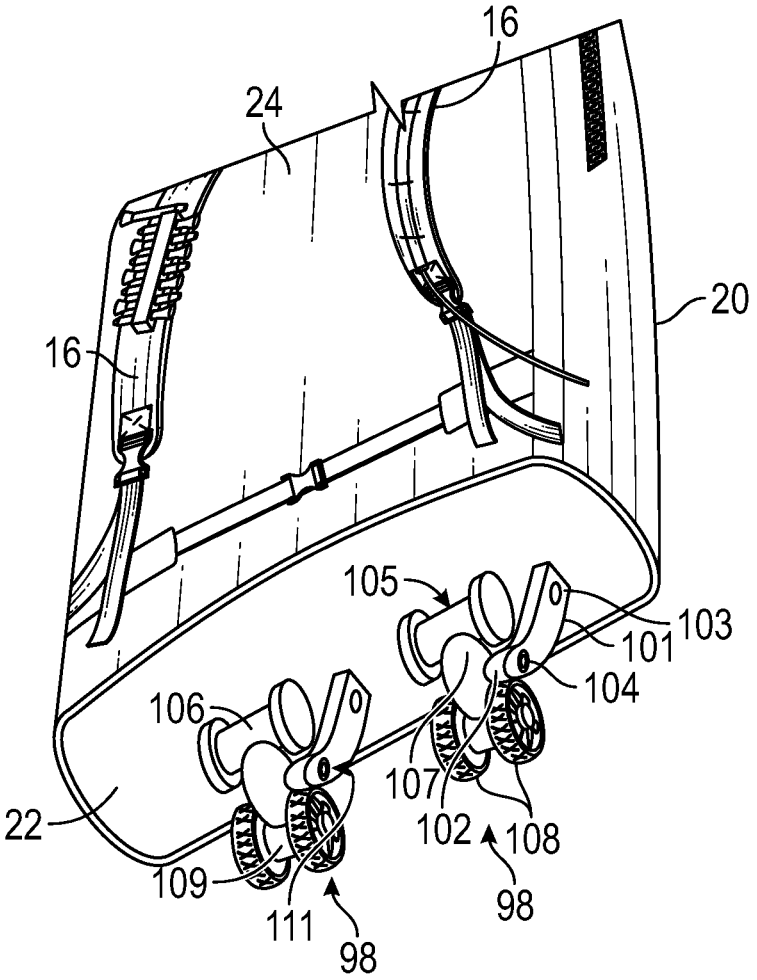
FIG. 12 is a bottom perspective view of an embodiment of the disclosure showing a pair of rollers in a deployed position.
Figure 13:
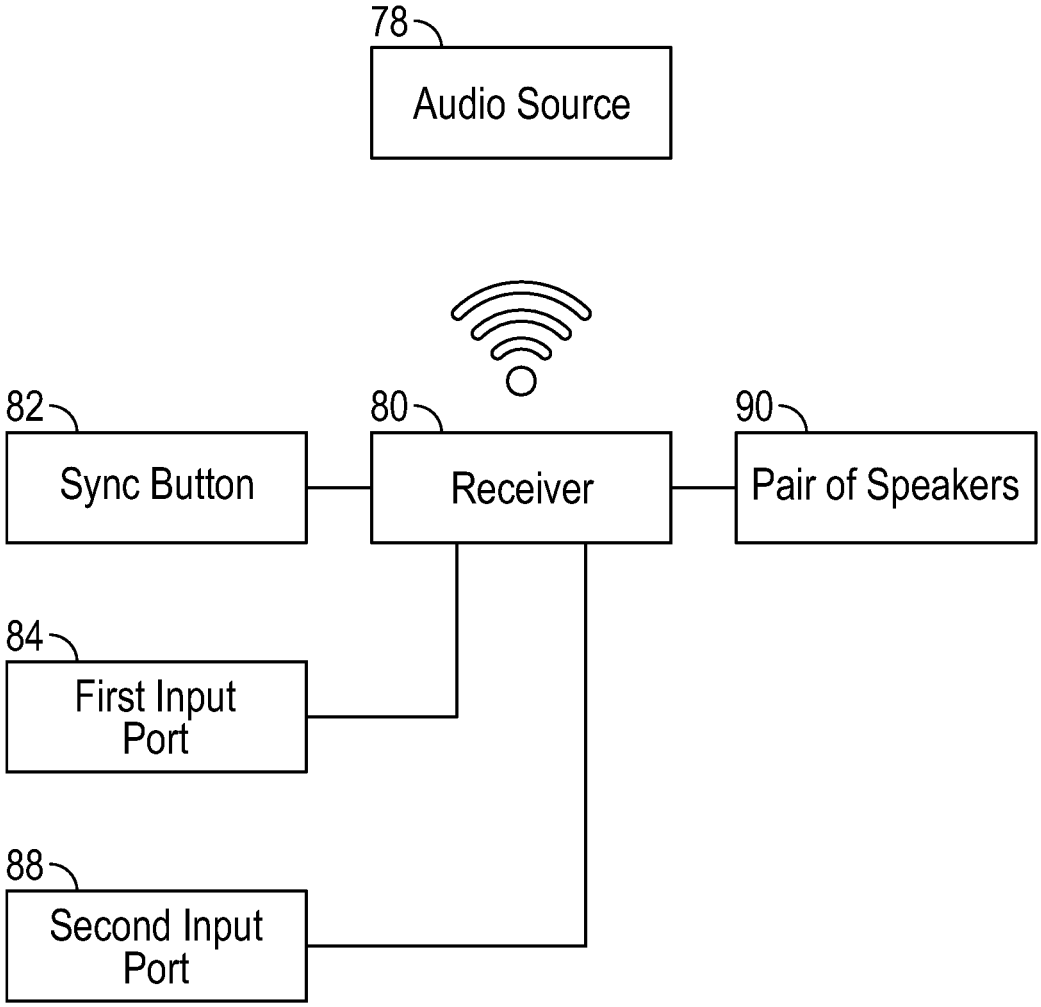
FIG. 13 is a schematic view of an embodiment of the disclosure.
Figure 14:
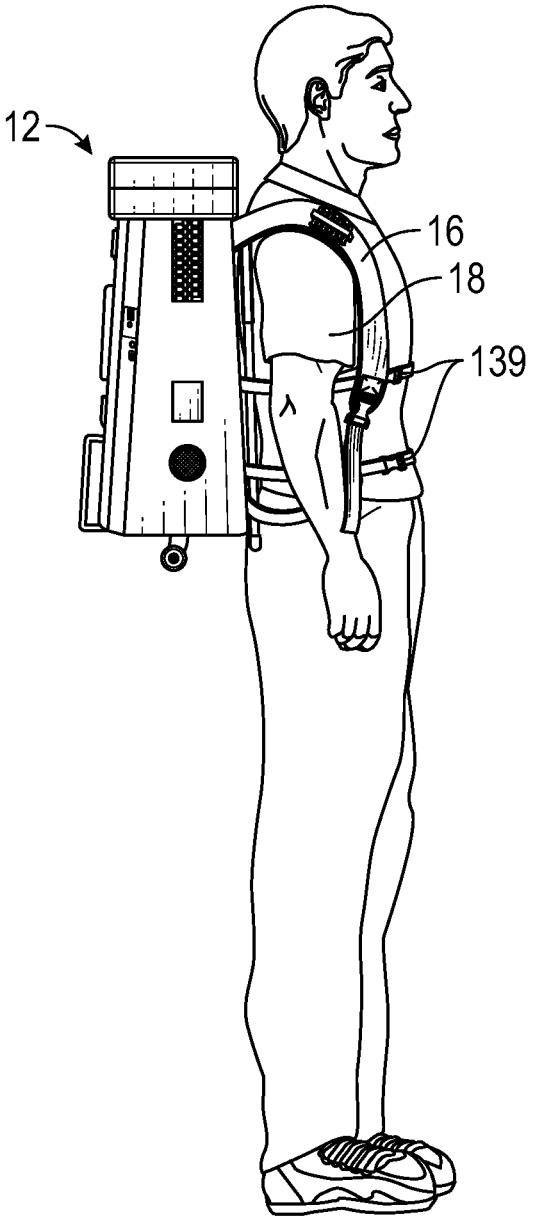
FIG. 14 is a perspective in-use view of an embodiment of the disclosure.

With reference now to the drawings, and in particular to FIGS. 1 through 14 thereof, a new golf bag device embodying the principles and concepts of an embodiment of the disclosure and generally designated by the reference numeral 10 will be described.

As best illustrated in FIGS. 1 through 14, the golf bag assembly 10 generally comprises an article of luggage 12 has a plurality of storage pockets 14 and a pair of shoulder straps 16 that is each wearable on a user's shoulders 18 for carrying the article of luggage 12. The article of luggage 12 has an outer wall 20 and a bottom wall 22 and the bottom wall 22 is recessed with respect to the outer wall 20. Each of the shoulder straps 16 is disposed on a back side 24 of the outer wall 20. The article of luggage 12 has a top end 26 that is open and a lid 27 is hingedly attached to the top end 26 for opening 34 and closing the top end 26.

A rotating mount 28 is rotatably attached to the article of luggage 12 and the rotating mount 28 is rotatable on the article of luggage 12. The rotating mount 28 comprises a ring 30 that is integrated into a front side 32 of the outer wall 20 of the article of luggage 12 such that the ring 30 extends outwardly from the front side 32. The ring 30 has an opening 34 extending through the ring 30 and the ring 30 is oriented such that the opening 34 is directed upwardly on the front side 32. The rotating mount 28 includes a pan 36 that has a forward wall 38 and a perimeter wall 40 extending away from the forward wall 38 and the pan 36 has a plurality of holes 42 each extending through the perimeter wall 40. The pan 36 is engaged to the ring 30 such that the perimeter wall 40 extends around the ring 30 has the perimeter wall 40 is spaced from the ring 30.

The rotating mount 28 includes a plurality of ball bearings 44 and each of the plurality of ball bearings 44 is positioned between the perimeter wall 40 of the pan 36 and the ring 30 thereby reducing friction between the perimeter wall 40 and the ring 30 when the pan 36 is rotated on the ring 30. The rotating mount 28 includes a lock 46 that has a stem 48 extending through the opening 34 in the ring 30 and a respective one of the holes 42 in the perimeter wall 40 of the pan 36 for retaining the pan 36 at a selected angle of rotation on the ring 30. The stem 48 is urgeable inwardly through the respective hole 42 to facilitate the pan 36 to be rotated on the ring 30. Furthermore, the lock 46 has a head 50 that is attached to the stem 48 such that the head 50 is positioned in the ring 30.

The rotating mount 28 includes a pair of biasing members 52 and each of the biasing members 52 is positioned between the head 50 and the ring 30 such that the biasing members 52 biases the stem 48 to extend outwardly through the opening 34 in the ring 30 and the respective hole 42 in the perimeter wall 40 of the pan 36. The rotating mount 28 includes a pair of first mating members 54 that is each attached to an outwardly facing surface 56 of the forward wall 38 of the pan 36. The first mating members 54 are spaced from each other and are oriented parallel with each other on the outwardly facing surface 56. Additionally, each of the first mating members 54 may comprise a hook portion of a hook and loop fastener or other type of multiple use, releasable mating member.

A golf club holder 58 is removably attachable to the rotating mount 28 and the golf club holder 58 includes a plurality of tubes 60. Each of the plurality of tubes 60 insertably receives a respective one of a plurality of golf clubs 62. The plurality of golf clubs 62 might include drivers, irons, putters and other golf clubs commonly employed in the game of golf. The golf club holder 58 includes a panel 64 that has a rear surface 66 and a front surface 68 and each of the plurality of tubes 60 is mounted to the front surface 68 of the panel 64. The plurality of tubes 60 is distributed laterally across the front surface 68 of the panel 64. The rear surface 66 has a well 70 extending toward the front surface 68 and the well 70 has a front bounding surface 72. Furthermore, the well 70 insertably receives the pan 36 such that the forward wall 38 of the pan 36 abuts the front bounding surface 72.

The golf club holder 58 includes a pair of second mating members 74 and each of the second mating members 74 is coupled to the front bounding surface 72 of the well 70 in the rear surface 66 of the panel 64. The second mating members 74 are spaced apart from each other and are oriented parallel with each other. Each of the second mating members 74 is releasably matable to a respective one of the first mating members 54 on the forward wall 38 of the pan 36 for attaching the golf club holder 58 to the forward wall 38 of the pan 36. Additionally, each of the second mating members 74 may comprise a loop portion of a hook and loop fastener or other type of multiple use, releasable mating member.

A communication unit 76 is provided and the communication unit 76 is integrated into the article of luggage 12. The communication unit 76 is in remote communication with an audio source 78 thereby facilitating the communication unit 76 to receive streaming audio from the audio source 78. The audio source 78 may comprise a smart phone or other type of personal electronic device that has wireless communication capabilities. The communication unit 76 comprises a receiver 80 that is integrated into the article of luggage 12 and the receiver 80 is in wireless communication with the audio source 78 such that the receiver 80 receives an audio signal from the audio source 78. The receiver 80 may comprise a radio frequency receiver or the like and the receiver 80 may employ Bluetooth communication protocols.

The communication unit 76 includes a sync button 82 that is movably integrated into the outer wall 20 of the article of luggage 12. The sync button 82 is electrically coupled to the receiver 80 and the receiver 80 is actuated to connect with the audio source 78 when the sync button 82 is depressed. The communication unit 76 includes a first input port 84 that is integrated into the outer wall 20 of the article of luggage 12 thereby facilitating the first input port 84 to receive a data cable 86 to receive an audio signal from the data cable 86. The first input port 84 may comprise a universal serial bus port or other type of digital data port. The communication unit 76 includes a second input port 88 that is integrated into the outer wall 20 of the article of luggage 12 thereby facilitating the second input port 88 to receive a data cable 86 to receive an audio signal from the data cable. The second input port 88 may comprise a 3.5 mm stereo port or the like.

A pair of speakers 90 is each integrated into the article of luggage 12 to emit audible sounds outwardly from the article of luggage 12. Each of the speakers 90 is in communication with the communication unit 76 and each of the speakers 90 is electrically coupled to the receiver 80 thereby facilitating the speakers 90 to audibly emit the audio signal from the audio source 78. Each of the speakers 90 includes a screen 92 integrated into the outer wall 20 of the article of luggage 12 to protect the speakers 90 and each of the speakers 90 may be positioned on a respective first lateral side 94 and second lateral side 96 of the outer wall 20 of the article of luggage 12. Each of the speakers 90 is hermetically sealed such that the speakers 90 can function normally in a wet environment as the result of precipitation and other sources of water that might be encountered on a golf course.

A pair of rollers 98 is each movably disposed on the article of luggage 12. Each of the rollers 98 is positionable in a retracted position thereby facilitating the article of luggage 12 to rest on a support surface 100. Conversely, each of the rollers 98 is positionable in a deployed position thereby facilitating the article of luggage 12 to be rolled on the rollers 98. Each of the rollers 98 comprises a mount 101 coupled to and extending downwardly from the bottom wall 22 of the article of luggage 12. The mount 101 has a distal end 102 with respect to the bottom wall 22 and the mount 101 is curved between the bottom wall 22 and the distal end 102. Furthermore, the mount 101 has a first engagement 103 positioned adjacent to the bottom wall 22 and the mount 101 has a second engagement 104 positioned adjacent to the distal end 102.

Each of the rollers 98 includes a hinge 105 rotatably mounted to the bottom wall 22 of the article of luggage 12 and the hinge 105 is positioned adjacent to the mount 101. The hinge 105 comprises a barrel 106 rotatably disposed on the bottom wall 22 and a member 107 extending away from the barrel 106. The hinge 105 is biased to rotate in a first direction having the member 107 extending downwardly from the bottom wall 22. The hinge 105 is urgeable to rotate in a second direction has the member 107 lying against the bottom wall 22.

Each of the rollers 98 includes a pair of wheels 108 that is each rotatably attached to opposing ends of an axle 109 and the axle 109 is attached to a distal end 110 of the member 107. Furthermore, the axle 109 is perpendicularly oriented with the member 107. Each of the wheels 108 is spaced downwardly from the bottom wall 22 when the hinge 105 rotates in the first direction thereby facilitating the wheels 108 to roll along the support surface 100. Additionally, each of the wheels 108 is positioned against the bottom wall 22 when the hinge 105 rotates in the second direction. Each of the wheels 108 may include a tire comprised of a resilient material, including but not being limited to rubber or silicone, to facilitate the wheels 108 to roll along uneven terrain that might commonly be encountered on a golf course, for example.

Each of the rollers 98 includes a lock 111 that is movably integrated into the member 107. The lock 111 is biased into an engaging position and the lock 111 is urgeable into a disengaging position. The lock 111 engages the second engagement 104 in the mount 101 when the hinge 105 rotates in the first direction and the lock 111 engages the first engagement 103 when the hinge 105 is urged to rotate in the second direction. The lock 111 is urged into the disengaging position to facilitate the hinge 105 to rotate in either the first direction or the second direction.

A rotation tube 112 is attached to the article of luggage 12 and the rotation tube 112 has a plurality of apertures 113 extending through an outer wall 141 of the rotation tube 112. Each of the plurality of apertures 113 is centrally located on the rotation tube 112 and the apertures 113 are spaced apart from each other and are distributed around a substantial circumference of the rotation tube 112. The rotation tube 112 is positioned on the back side 24 of the outer wall 20 of the article of luggage 12. Furthermore, the rotation tube 112 is positioned proximate the top end 26 of the article of luggage 12 and the rotation tube 112 is horizontally oriented on the back side 24.

A handle 114 is pivotally coupled to the article of luggage 12 and the handle 114 is positionable in a deployed position having the handle 114 extending upwardly from the article of luggage 12 thereby facilitating the handle 114 to be gripped for transporting the article of luggage 12 on the rollers 98. Conversely, the handle 114 is positionable in a stored position having the handle 114 angling downwardly from the article of luggage 12 thereby facilitating the handle 114 to support the article of luggage 12 in the convention of a kickstand. The handle 114 has an upper member 115, a lower member 116 and a pair of outward members 117 each extending between the upper member 115 and the lower member 116. Each of the outward members 117 is perpendicularly oriented with the upper member 115 and the lower member 116. The upper member 115 extends through the rotation tube 112 and the upper member 115 is substantially hollow.

The upper member 115 has a hole 118 extending into an interior of the upper member 115 and the handle 114 is pivotable such that the hole 118 is aligned with a respective one of the apertures 113 in the rotation tube 112. Each of the outward members 117 comprises a first tube 120 that slidably engages a second tube 121 such that each of the outward members 117 has a telescopically adjustable length. The first tube 120 of each of the outward members 117 has a plurality of engagement points 122 arranged into a row. The second tube 121 of each of the outward members 117 has a handle lock 123 which releasably engages a respective one of the engagement points 122 on the first tube 120 of a respective outward member 117 for retaining the handle 114 at a desired length.

A lock 124 is movably positioned within the upper member 115 of the handle 114. The lock 124 in the upper member 115 is biased into a locking position and the lock 124 in the upper member 115 is urgeable into a releasing position. The lock 124 in the upper member 115 includes a stem 125 extending outwardly through the hole 118 in the upper member 115 and outwardly through a respective one of the apertures 113 in the rotation tube 112 for retaining the handle 114 at a selected angle when the lock 124 in the upper member 115 is in the locking position. The lock 124 in the upper member 115 is urged into the releasing position when the stem 125 is pushed inwardly in the upper member 115. A biasing member 126 is positioned within the upper member 115 of the handle 114 and the biasing member 126 in the upper member 115 engages the lock 124 in the upper member 115 for biasing the lock 124 in the upper member 115 into the locking position.

A golf tee holder 127 is attached to a respective one of the shoulder straps 16 and the golf tee holder 127 has a plurality of holes 128 that each extends laterally through the golf tee holder 127 for insertably receiving a plurality of golf tees 129. A fluid reservoir 130 is integrated into the article of luggage 12 for containing a beverage such as water, for example, and a drinking hose 131 is fluidly coupled to the fluid reservoir 130. The drinking hose 131 extends along a respective one of the shoulder straps 16 to facilitate the user to drink the beverage through the drinking hose 131. A plurality of storage pouches 133 are disposed on the article of luggage 12 and the plurality of storage pouches 133 are strategically distributed on the article of luggage 12. Each of the storage pouches 133 is comprised of a fluid impermeable material thereby inhibiting objects stored in the storage pouches 133 from becoming wet. A carrying grip 134 is attached to the top end 26 of the article of luggage 12 to facilitate the article of luggage 12 to be carried without gripping the handle 114. The carrying grip 134 is positioned adjacent to the rotation tube 112 and the carrying grip 134 extends upwardly from the article of luggage 12.

A plurality of attachment rings 135 is each attached to the front side 32 of the outer wall 20 of the article of luggage 12 and the attachment rings 135 are distributed around the rotation ring 30. A rain fly 136 is provided the rain fly 136 has a plurality of lobes 137 that radiate outwardly from the rain fly 136. Each of the lobes 137 has an attachment 138 that can releasably engage a respective one of the attachment rings 135. In this way the rain fly 136 can cover the rotation ring 30 when the golf club holder 58 is not attached to the rotation ring 30. A plurality of first straps 139 is provided and each of the plurality of first straps 139 is coupled to a respective one of the shoulder straps 16. A plurality of second straps 140 is provided and each of the plurality of second straps 140 is coupled to a respective one of the shoulder straps 16. Each of the first straps 139 is releasably matable to a respective one of the second straps 140 to extend across the user's body when the shoulder straps 16 are worn on the user's shoulders 18.

In use, the article of luggage 12 can be employed as a backpack or day bag while the rollers 98 are retracted. The golf club holder 58 can attached to the rotating mount 28 to facilitate the golf clubs 62 to be stored on the article of luggage 12 during the game of golf. In this way the article of luggage can perform a variety of functions. Furthermore, the rollers 98 can be placed in the deployed position and the handle 114 can be positioned in the deployed position to facilitate the article of luggage 12 to be rolled rather than being carried. The handle 114 can be positioned at a variety of angles and locked into place with the lock 124 in the upper member 115 of the handle 114 to facilitate the article of luggage 12 to be leaned on the handle 114 when the article of luggage 12 is not being transported. The communication unit 76 can be synched with the audio source 78 for streaming audio through the speakers 90 for entertaining the user during the game of golf.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A golf bag assembly for storing golf clubs and streaming audio from an electronic device, said assembly comprising:

an article of luggage having a plurality of storage pockets and a pair of shoulder straps each being wearable on a user's shoulders for carrying said article of luggage;

a rotating mount being rotatably attached to said article of luggage;

a golf club holder being removably attachable to said rotating mount, said golf club holder having a plurality of tubes, each of said plurality of tubes insertably receiving a respective one of a plurality of golf clubs;

a communication unit being integrated into said article of luggage, said communication unit being in remote communication with an audio source thereby facilitating said communication unit to receive streaming audio from the audio source;

a pair of speakers, each of said speakers being integrated into said article of luggage wherein each of said speakers is configured to emit audible sounds outwardly from said article of luggage, each of said speakers being in communication with said communication unit;

a pair of rollers, each of said rollers being movably disposed on said article of luggage, each of said rollers being positionable in a retracted position thereby facilitating said article of luggage to rest on a support surface, each of said rollers being positionable in a deployed position thereby facilitating said article of luggage to be rolled on said rollers;

a rotation tube being attached to said article of luggage; and a handle being rotatably coupled to said rotation tube, said handle being positionable in a deployed position having said handle extending upwardly from said article of luggage thereby facilitating said handle to be gripped for transporting said article of luggage on said rollers, said handle being positionable in a stored position having said handle angling downwardly from said article of luggage thereby facilitating said handle to support said article of luggage in the convention of a kickstand.

2. The assembly according to claim 1, wherein:

said article of luggage has an outer wall and a bottom wall, said bottom wall being recessed with respect to said outer wall, each of said shoulder straps being disposed on a back side of said outer wall, said article of luggage having a top end being open, said article of luggage having a lid being hingedly attached to said top end for opening and closing said top end; and said rotating mount comprises a ring being integrated into a front side of said outer wall of said article of luggage such that said ring extends outwardly from said front side, said ring having an opening extending through said ring, said ring being oriented such that said opening is directed upwardly on said front side.

3. The assembly according to claim 2, wherein said rotating mount includes:

a pan having a forward wall and a perimeter wall extending away from said forward wall, said pan having a plurality of holes each extending through said perimeter wall, said pan being engaged to said ring such that said perimeter wall extends around said ring having said perimeter wall being spaced from said ring;

a plurality of ball bearings, each of said plurality of ball bearings being positioned between said perimeter wall of said pan and said ring thereby reducing friction between said perimeter wall and said ring when said pan is rotated on said ring;

a lock having a stem extending through said opening in said ring and a respective one of said holes in said perimeter wall of said pan for retaining said pan at a selected angle of rotation on said ring, said stem being urgeable inwardly through said respective hole to facilitate said pan to be rotated on said ring, said lock having head being attached to said stem such that said head is positioned in said ring;

a pair of biasing members, each of said biasing members being positioned between said head and said ring such that said biasing members biases said stem to extend outwardly through said opening in said ring and said respective hole in said perimeter wall of said pan; and a pair of first mating members, each of said first mating member being attached to an outwardly facing surface of said forward wall of said pan, said first mating members being spaced from each other and being oriented parallel with each other on said outwardly facing surface.

4. The assembly according to claim 3, wherein said golf club holder includes:

a panel having a rear surface and a front surface, each of said plurality of tubes being mounted to said front surface of said panel, said plurality of tubes being distributed laterally across said front surface of said panel, said rear surface having a well extending toward said front surface, said well having a front bounding surface, said well insertably receiving said pan such that said forward wall of said pan abuts said front bounding surface; and a pair of second mating members, each of said second mating members being coupled to said front bounding surface of said well in said rear surface of said panel, said second mating members being spaced apart from each other and being oriented parallel with each other, each of said second mating members being releasably matable to a respective one of said first mating members on said forward wall of said pan for attaching said golf club holder to said forward wall of said pan.

5. The assembly according to claim 1, wherein:

said communication unit comprises:

a receiver being integrated into said article of luggage, said receiver being in wireless communication with the audio source such that said receiver receives an audio signal from the audio source;

a sync button being movably integrated into said outer wall of said article of luggage, said sync button being electrically coupled to said receiver, said receiver being actuated to connect with the audio source when said sync button is depressed;

a first input port being integrated into said outer wall of said article of luggage thereby facilitating said first input port to receive a data cable to receive an audio signal from the data cable; and a second input port being integrated into said outer wall of said article of luggage thereby facilitating said second input port to receive a data cable to receive an audio signal from the data cable; and each of said speakers is electrically coupled to said receiver thereby facilitating said speakers to audibly emit the audio signal from the audio source.

6. The assembly according to claim 1, wherein:

said article of luggage has an outer wall and a bottom wall, said bottom wall being recessed with respect to said outer wall, each of said shoulder straps being disposed on a back side of said outer wall; and each of said rollers comprises:

a mount being coupled to and extending downwardly from said bottom wall of said article of luggage, said mount having a distal end with respect to said bottom wall, said mount being curved between said bottom wall and said distal end, said mount having a first engagement being positioned adjacent to said bottom wall, said mount having a second engagement being positioned adjacent to said distal end; and a hinge being rotatably mounted to said bottom wall of said article of luggage, said hinge being positioned adjacent to said mount, said hinge comprising a barrel being rotatably disposed on said bottom wall and a member extending away from said barrel, said hinge being biased to rotate in a first direction having said member extending downwardly from said bottom wall, said hinge being urgeable to rotate in a second direction having said member lying against said bottom wall.

7. The assembly according to claim 6, wherein each of said rollers includes:

a pair of wheels, each of said wheels being rotatably attached to opposing ends of an axle, said axle being attached to a distal end of said member, each of said wheels being spaced downwardly from said bottom wall when said hinge rotates in said first direction thereby facilitating said wheels to roll along the support surface, each of said wheels being positioned against said bottom wall when said hinge rotates in said second direction; and a lock being movably integrated into said member, said lock being biased into an engaging position, said lock being urgeable into a disengaging position, said lock engaging said second engagement in said mount when said hinge rotates in said first direction, said lock engaging said first engagement when said hinge is urged to rotate in said second direction, said lock being urged into said disengaging position to facilitate said hinge to rotate in either said first direction or said second direction.

8. The assembly according to claim 1, wherein:

said article of luggage has an outer wall and a bottom wall, said outer wall having a back side; and said rotation tube has a plurality of apertures extending through an outer wall of said rotation tube, each of said plurality of apertures being centrally located on said rotation tube, said plurality of apertures being spaced apart from each other and being distributed around a substantial circumference of said rotation tube, said rotation tube being positioned on said back side of said outer wall of said article of luggage, said rotation tube being positioned proximate said top end of said article of luggage, said rotation tube being horizontally oriented on said back side.

9. The assembly according to claim 8, wherein said handle has an upper member and a lower member and a pair of outward members each extending between said upper member and said lower member, each of said outward members being perpendicularly oriented with said upper member and said lower member, said upper member extending through said rotation tube, said upper member being substantially hollow, said upper member having a hole extending into an interior of said upper member, said handle being pivotable such that said hole is aligned with a respective one of said apertures in said rotation tube.

10. The assembly according to claim 9, wherein each of said outward members comprising a first tube slidably engaging a second tube such that each of said outward members has a telescopically adjustable length, said first tube of each of said outward members having a plurality of engagement points being arranged into a row, said second tube of each of said outward members having a handle lock which releasably engages a respective one of said engagement points on said first tube of a respective outward member for retaining said handle at a desired length.

11. The assembly according to claim 9, further comprising:

a lock being movably positioned within said upper member of said handle, said lock being biased into a locking position, said lock being urgeable into a releasing position, said lock including a stem extending outwardly through said hole in said upper member and outwardly through a respective one of said apertures in said rotation tube for retaining said handle at a selected angle when said lock is in said locking position, said lock being urged into said releasing position when said stem is pushed inwardly in said upper member; and a biasing member being positioned within said upper member of said handle, said biasing member engaging said lock for biasing said lock into said locking position.

12. A golf bag assembly for storing golf clubs and streaming audio from an electronic device, said assembly comprising:

an article of luggage having a plurality of storage pockets and a pair of shoulder straps each being wearable on a user's shoulders for carrying said article of luggage, said article of luggage having an outer wall and a bottom wall, said bottom wall being recessed with respect to said outer wall, each of said shoulder straps being disposed on a back side of said outer wall, said article of luggage having a top end being open, said article of luggage having a lid being hingedly attached to said top end for opening and closing said top end;

a rotating mount being rotatably attached to said article of luggage, said rotating mount comprising:

a ring being integrated into a front side of said outer wall of said article of luggage such that said ring extends outwardly from said front side, said ring having an opening extending through said ring, said ring being oriented such that said opening is directed upwardly on said front side;

a pan having a forward wall and a perimeter wall extending away from said forward wall, said pan having a plurality of holes each extending through said perimeter wall, said pan being engaged to said ring such that said perimeter wall extends around said ring having said perimeter wall being spaced from said ring;

a plurality of ball bearings, each of said plurality of ball bearings being positioned between said perimeter wall of said pan and said ring thereby reducing friction between said perimeter wall and said ring when said pan is rotated on said ring;

a lock having a stem extending through said opening in said ring and a respective one of said holes in said perimeter wall of said pan for retaining said pan at a selected angle of rotation on said ring, said stem being urgeable inwardly through said respective hole to facilitate said pan to be rotated on said ring, said lock having head being attached to said stem such that said head is positioned in said ring;

a pair of biasing members, each of said biasing members being positioned between said head and said ring such that said biasing members biases said stem to extend outwardly through said opening in said ring and said respective hole in said perimeter wall of said pan; and a pair of first mating members, each of said first mating member being attached to an outwardly facing surface of said forward wall of said pan, said first mating members being spaced from each other and being oriented parallel with each other on said outwardly facing surface;

a golf club holder being removably attachable to said rotating mount, said golf club holder having a plurality of tubes, each of said plurality of tubes insertably receiving a respective one of a plurality of golf clubs, said golf club holder including:

a panel having a rear surface and a front surface, each of said plurality of tubes being mounted to said front surface of said panel, said plurality of tubes being distributed laterally across said front surface of said panel, said rear surface having a well extending toward said front surface, said well having a front bounding surface, said well insertably receiving said pan such that said forward wall of said pan abuts said front bounding surface; and a pair of second mating members, each of said second mating members being coupled to said front bounding surface of said well in said rear surface of said panel, said second mating members being spaced apart from each other and being oriented parallel with each other, each of said second mating members being releasably matable to a respective one of said first mating members on said forward wall of said pan for attaching said golf club holder to said forward wall of said pan;

a communication unit being integrated into said article of luggage, said communication unit being in remote communication with an audio source thereby facilitating said communication unit to receive streaming audio from the audio source, said communication unit comprising:

a receiver being integrated into said article of luggage, said receiver being in wireless communication with the audio source such that said receiver receives an audio signal from the audio source;

a sync button being movably integrated into said outer wall of said article of luggage, said sync button being electrically coupled to said receiver, said receiver being actuated to connect with the audio source when said sync button is depressed;

a first input port being integrated into said outer wall of said article of luggage thereby facilitating said first input port to receive a data cable to receive an audio signal from the data cable; and a second input port being integrated into said outer wall of said article of luggage thereby facilitating said second input port to receive a data cable to receive an audio signal from the data cable;

a pair of speakers, each of said speakers being integrated into said article of luggage wherein each of said speakers is configured to emit audible sounds outwardly from said article of luggage, each of said speakers being in communication with said communication unit, each of said speakers being electrically coupled to said receiver thereby facilitating said speakers to audibly emit the audio signal from the audio source;

a pair of rollers, each of said rollers being movably disposed on said article of luggage, each of said rollers being positionable in a retracted position thereby facilitating said article of luggage to rest on a support surface, each of said rollers being positionable in a deployed position thereby facilitating said article of luggage to be rolled on said rollers, each of said rollers comprising:

a mount being coupled to and extending downwardly from said bottom wall of said article of luggage, said mount having a distal end with respect to said bottom wall, said mount being curved between said bottom wall and said distal end, said mount having a first engagement being positioned adjacent to said bottom wall, said mount having a second engagement being positioned adjacent to said distal end;

a hinge being rotatably mounted to said bottom wall of said article of luggage, said hinge being positioned adjacent to said mount, said hinge comprising a barrel being rotatably disposed on said bottom wall and a member extending away from said barrel, said hinge being biased to rotate in a first direction having said member extending downwardly from said bottom wall, said hinge being urgeable to rotate in a second direction having said member lying against said bottom wall;

a pair of wheels, each of said wheels being rotatably attached to opposing ends of an axle, said axle being attached to a distal end of said member, each of said wheels being spaced downwardly from said bottom wall when said hinge rotates in said first direction thereby facilitating said wheels to roll along the support surface, each of said wheels being positioned against said bottom wall when said hinge rotates in said second direction; and a lock being movably integrated into said member, said lock being biased into an engaging position, said lock being urgeable into a disengaging position, said lock engaging said second engagement in said mount when said hinge rotates in said first direction, said lock engaging said first engagement when said hinge is urged to rotate in said second direction, said lock being urged into said disengaging position to facilitate said hinge to rotate in either said first direction or said second direction;

a rotation tube being attached to said article of luggage, said rotation tube having a plurality of apertures extending through an outer wall of said rotation tube, each of said plurality of apertures being centrally located on said rotation tube, said plurality of apertures being spaced apart from each other and being distributed around a substantial circumference of said rotation tube, said rotation tube being positioned on said back side of said outer wall of said article of luggage, said rotation tube being positioned proximate said top end of said article of luggage, said rotation tube being horizontally oriented on said back side;

a handle being rotatably coupled to said rotation tube, said handle being positionable in a deployed position having said handle extending upwardly from said article of luggage thereby facilitating said handle to be gripped for transporting said article of luggage on said rollers, said handle being positionable in a stored position having said handle angling downwardly from said article of luggage thereby facilitating said handle to support said article of luggage in the convention of a kickstand, said handle having an upper member and a lower member and a pair of outward members each extending between said upper member and said lower member, each of said outward members being perpendicularly oriented with said upper member and said lower member, said upper member extending through said rotation tube, said upper member being substantially hollow, said upper member having a hole extending into an interior of said upper member, said handle being pivotable such that said hole is aligned with a respective one of said apertures in said rotation tube, each of said outward members comprising a first tube slidably engaging a second tube such that each of said outward members has a telescopically adjustable length, said first tube of each of said outward members having a plurality of engagement points being arranged into a row, said second tube of each of said outward members having a handle lock which releasably engages a respective one of said engagement points on said first tube of a respective outward member for retaining said handle at a desired length;

a lock being movably positioned within said upper member of said handle, said lock in said upper member being biased into a locking position, said lock in said upper member being urgeable into a releasing position, said lock in said upper member including a stem extending outwardly through said hole in said upper member and outwardly through a respective one of said apertures in said rotation tube for retaining said handle at a selected angle when said lock in said upper member is in said locking position, said lock in said upper member being urged into said releasing position when said stem is pushed inwardly in said upper member; and a biasing member being positioned within said upper member of said handle, said biasing member engaging said lock in said upper member for biasing said lock in said upper member into said locking position.

* * * * *